US012484705B2

(12) United States Patent
Hill et al.

(10) Patent No.: US 12,484,705 B2
(45) Date of Patent: Dec. 2, 2025

(54) ADJUSTABLE BED ASSEMBLY

(71) Applicant: Ergomotion, Inc., Goleta, CA (US)

(72) Inventors: Carli Hill, Monroe, WA (US); Joseph Ermalovich, Santa Barbara, CA (US)

(73) Assignee: Ergomotion, Inc., Goleta, CA (US)

( * ) Notice: Subject to any disclaimer, the term of this patent is extended or adjusted under 35 U.S.C. 154(b) by 272 days.

(21) Appl. No.: 18/312,882

(22) Filed: May 5, 2023

(65) Prior Publication Data

US 2023/0355002 A1 Nov. 9, 2023

Related U.S. Application Data

(60) Provisional application No. 63/364,302, filed on May 6, 2022.

(51) Int. Cl.
*A47C 20/04* (2006.01)
*A47C 23/00* (2006.01)

(52) U.S. Cl.
CPC ..... *A47C 20/041* (2013.01); *A47C 23/005* (2013.01)

(58) Field of Classification Search
CPC ..... A47C 20/04; A47C 20/041; A47C 20/042; A47C 20/043; A47C 20/045; A47C 20/046; A47C 20/047; A47C 20/048; A47C 17/00; A47C 23/00; A47C 23/005; A47C 23/06; A47C 23/061; A47C 23/062; A47C 19/02; A47C 27/00
See application file for complete search history.

(56) References Cited

U.S. PATENT DOCUMENTS 4,899,404 A * 2/1990 Galumbeck ..... A47C 20/041 5/616
5,345,630 A 9/1994 Healy
(Continued)

FOREIGN PATENT DOCUMENTS

CN 114847712 A 8/2022
EP 1192883 A2 4/2002
(Continued)

OTHER PUBLICATIONS

International Search Report for Application No. PCT/US2023/066659; mailed Sep. 4, 2023; 4 pp.
(Continued)

*Primary Examiner* — George Sun
(74) *Attorney, Agent, or Firm* — Bodman PLC

(57) ABSTRACT

An adjustable bed system includes a mattress and an adjustment mechanism. The mattress includes a head portion and a foot portion rearward of the head portion. The head portion defines a cavity that is downwardly open. The adjustment mechanism includes a lower base, an upper support that is movably coupled to the lower base, and an actuator operable to move the upper support relative to the lower base. The adjustment mechanism is positioned in the cavity and is coupled to the mattress. When the actuator is operated, the adjustment mechanism moves the adjustable bed system between a flat configuration in which the head portion is substantially coplanar with the foot portion and an inclined configuration in which the head portion is inclined relative to the foot portion.

22 Claims, 16 Drawing Sheets

(56) References Cited

U.S. PATENT DOCUMENTS 5,870,784 A * 2/1999 Elliott ..... A47C 20/041 5/616
6,061,852 A * 5/2000 Bathrick ..... A61G 7/015 5/618
6,079,065 A * 6/2000 Luff ..... A47C 27/082 5/616
6,684,425 B2 2/2004 Davis
6,901,722 B2 6/2005 Dextraze et al.
7,293,309 B1 * 11/2007 Shih ..... A47C 20/041 5/618
8,266,746 B2 9/2012 Oh et al.
8,561,235 B2 10/2013 Oh et al.
8,863,332 B2 10/2014 Rohr
2003/0041378 A1 3/2003 Davis
2005/0066624 A1 * 3/2005 Dextraze ..... B65B 31/06 53/399
2008/0262657 A1 * 10/2008 Howell ..... A47C 20/041 700/275
2009/0211028 A1 * 8/2009 Richmond ..... A47C 20/08 5/717
2010/0186168 A1 * 7/2010 Harrison ..... A47C 20/041 5/616
2011/0247144 A1 * 10/2011 Oh ..... A47C 20/041 5/737
2012/0073059 A1 * 3/2012 Oh ..... A47C 21/022 5/497
2012/0102646 A1 * 5/2012 Chen ..... A44B 19/22 112/475.17
2014/0101863 A1 * 4/2014 Rohr ..... A47C 20/041 5/722
2015/0305510 A1 * 10/2015 Tarplee ..... A47C 20/041 601/57
2021/0145185 A1 * 5/2021 Negus ..... A47C 20/048

FOREIGN PATENT DOCUMENTS

EP 1525824 A1 4/2005
WO 9524880 A1 9/1995

OTHER PUBLICATIONS

International Search Report & Written Opinion for Application No. PCT/US2024/055162, mailed Feb. 19, 2025; 9 pp.

* cited by examiner

ADJUSTABLE BED ASSEMBLY

CROSS-REFERENCE TO RELATED APPLICATION(S)

This application claims priority to and the benefit of U.S. Provisional Application No. 63/364,302, filed May 6, 2022, the entire disclosure of which is incorporated by reference herein.

TECHNICAL FIELD

The present disclosure relates to beds and, in particular, adjustable bed systems.

BACKGROUND

Adjustable beds may provide comfort to users in home and care settings. It would be advantageous to provide an adjustable bed system that, among other benefits, is compressible for storing and shipping.

SUMMARY

Disclosed herein are implementations of adjustable bed assemblies and related methods.

In an implementation, an adjustable bed system includes a mattress and an adjustment mechanism. The mattress includes a head portion and a foot portion rearward of the head portion. The head portion defines a cavity that is downwardly open. The adjustment mechanism includes a lower base, an upper support that is movably coupled to the lower base, and an actuator operable to move the upper support relative to the lower base. The adjustment mechanism is positioned in the cavity and is coupled to the mattress. When the actuator is operated, the adjustment mechanism moves the adjustable bed system between a flat configuration in which the head portion is substantially coplanar with the foot portion and an inclined configuration in which the head portion is inclined relative to the foot portion.

The head portion may include an upper subportion having a downward facing surface that defines the cavity, and the upper support of the adjustment mechanism may be coupled to the downward facing surface. The upper support of the adjustment mechanism may be coupled to the downward facing surface with a hook and loop fastener system. The upper support may include one or more support panels that form one side of the hook and loop fastener system, and the downward facing surface may include one or more mattress panels that form another side of the hook and loop fastener system and are coupled to the one or more support panels.

The adjustable bed system may further include a coupler that couples the lower base of the adjustment mechanism to a coupling portion of the mattress rearward of the cavity to prevent forward movement of the adjustment mechanism relative to the foot portion of the mattress. The coupling portion may not move relative to a flat support surface on which the adjustable bed system is positioned when the adjustment mechanism moves the adjustable bed system between the flat configuration and the inclined configuration. The coupler may include one or more panels that are flexible, each having a first end coupled to the lower base and a second end coupled to the coupling portion. The first end may be coupled to the lower base with a zipper. The one or more panels may cooperatively span less than half a width of the cavity. The one or more panels may be releasably coupleable to the mattress at one or more of a head-end of the cavity or sides of the cavity. The one or more panels may enclose the adjustment mechanism in the cavity.

According to an implementation, an adjustable bed system includes a mattress and an adjustment mechanism. The mattress includes a head portion and a foot portion. The adjustment mechanism lifts the head portion from a first configuration in which a first upper surface of the head portion and a second upper surface of the foot portion are substantially coplanar and a second configuration in which first upper surface is inclined relative to the second upper surface. In a third configuration, the first upper surface faces the second upper surface, and the head portion of the mattress is compressed a lesser distance from a relaxed state thereof than is the foot portion of the mattress compressed from a relaxed state thereof.

In the third configuration, the head portion of the mattress and the foot portion of the mattress may be compressed by removable packaging. The removable packing may be a vacuum bag in which the mattress and the adjustment mechanism are enclosed. The head portion of the mattress may define a cavity in which is positioned the adjustment mechanism.

According to an implementation, an adjustable bed system includes a mattress having a head portion and a foot portion and an adjustment mechanism. The adjustment mechanism includes a lower base, an upper support pivotably coupled to the lower base, and an actuator operable to move the upper support upward relative to the lower base. The adjustment mechanism is configured to raise the head portion of the mattress when the actuator is operated from a first configuration to a second configuration. The lower base of the adjustment mechanism is coupled to a coupling portion of the mattress to prevent movement of the lower base in a forward direction away from the foot portion of the mattress.

The lower base may include a frame having a head-end member and a foot-end member that are spaced apart longitudinally and a left side member and a right side member that are spaced apart laterally and extend between and are coupled to the head-end member and the foot-end member. The head-end member may be coupled to the coupling portion of the mattress with a coupler extending therebetween. The coupler may include a flexible panel that is wrapped around the head-end member of the frame of the lower base. The frame of the lower base may include a stanchion that extends upward from the head-end member and engages the upper support when the adjustable bed system is in the first configuration. The forward end of the coupler may be wrapped around the head-end member on different sides of the stanchion.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
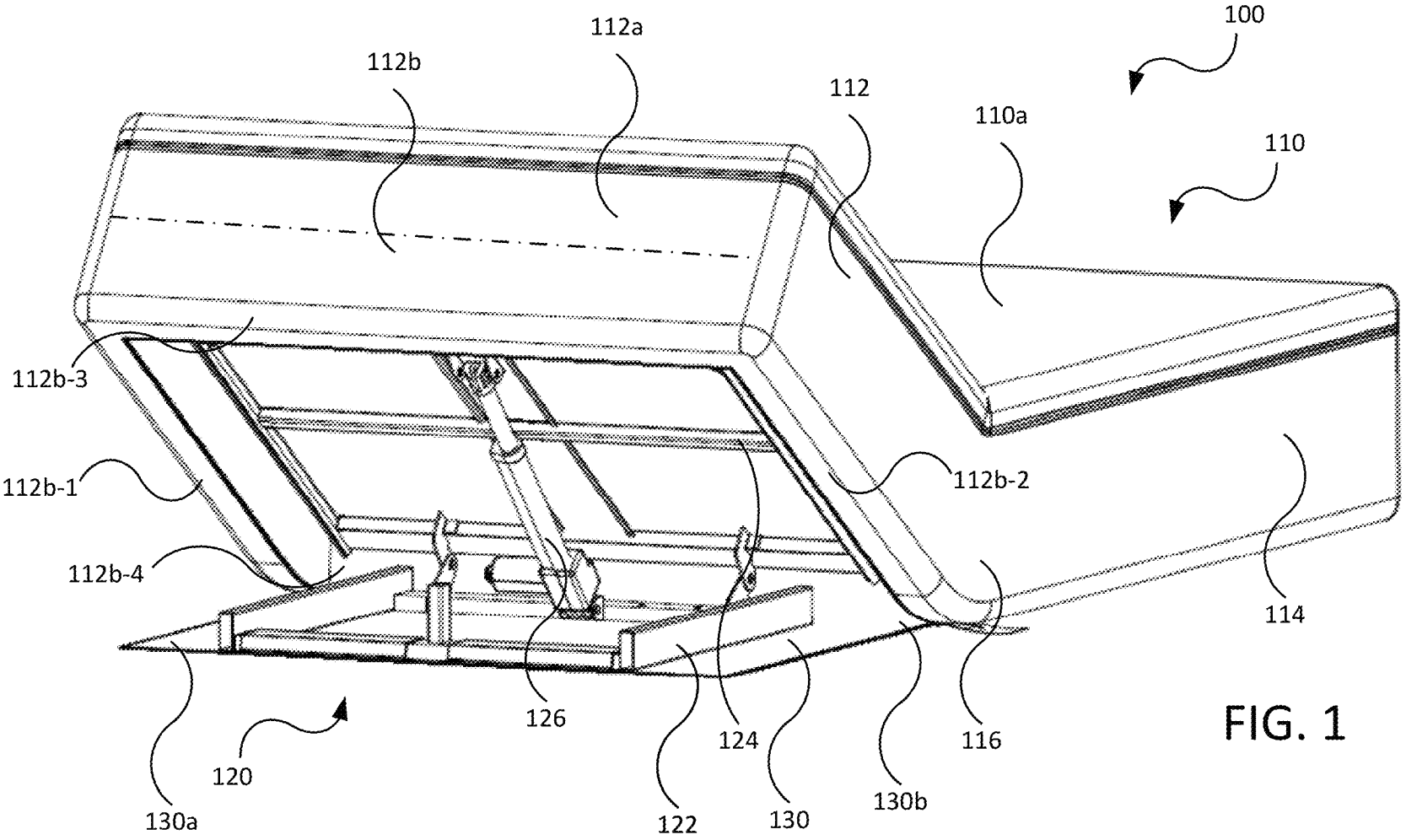
FIG. 1 is an upper, front, right perspective view of a first embodiment of an adjustable bed system having a mattress and an adjustment mechanism in an inclined configuration.

Referring to FIGS. 1-9, an adjustable bed system 100 generally includes a mattress 110 and an adjustment mechanism 120 configured to move the mattress 110 between different positions when in use. For example, in use, the adjustable bed system 100 is reconfigurable between a first or flat configuration (see, e.g., FIG. 9) in which upper surfaces of a head portion 112 and a foot portion 114 of the mattress 110 are substantially coplanar with each other (e.g., level) and a second or inclined configuration (see, e.g., FIGS. 1-3) in which the upper surface of the head portion 112 is inclined relative to that of the foot portion 114 (e.g., remaining level) by being pivoted about a central portion 116 of the mattress 110. The adjustable bed system 100 is configured to be supported by a flat support surface, such as slats or a platform of a bed frame, bed foundation, or floor.

When not in use, for example, when the adjustable bed system 100 is stored or transported, the adjustable bed system 100 may be arranged in a third or collapsed configuration in which the foot portion 114 of the mattress 110 is folded over the head portion 112 with the upper surfaces thereof being positioned against or otherwise facing each other (e.g., with packaging therebetween). In the third configuration, the head portion 112 and the foot portion 114 of the mattress 110 may also be compressed, for example, with external packaging to reduce the spatial volume of the adjustable bed system 100, as compared to when in the in-use configurations, for storage or transport. The first or reclined position may also be referred to as a horizontal or recumbent configuration or position. The second or inclined configuration may also be referred to as an elevated or sitting configuration or position.

Various directional terms are used to describe various components, features, and functions of the adjustable bed system 100 described herein and may be used in orientation relative to parts of a bed. The term "head" generally refers to a head of a bed, which is the side of a bed at which a person will typically position their head. The term "foot" generally refers to a foot of a bed, which is the side of a bed at which a person will typically position their feet. Directional variations of "head," such as "head-side" and "head-end" typically refer to components or features nearer to a head of a bed than a foot of the bed. The terms "headward" and "forward" refer to a direction toward the head of the bed. Directional variations of "foot," such as "foot-side" and "foot-end" typically refer to components or features nearer to a foot of a bed than a head of the bed. The terms "footward" and "rearward" refer to a direction toward the foot of the bed. The terms longitudinal and length are in the direction extending between a head and a foot of the bed. The terms lateral and width are in the direction extending between left and right sides of the bed. Elevational terms, such as upward, upper, downward, lower, and inclined are generally in the nominally vertical direction.

Figure 2:
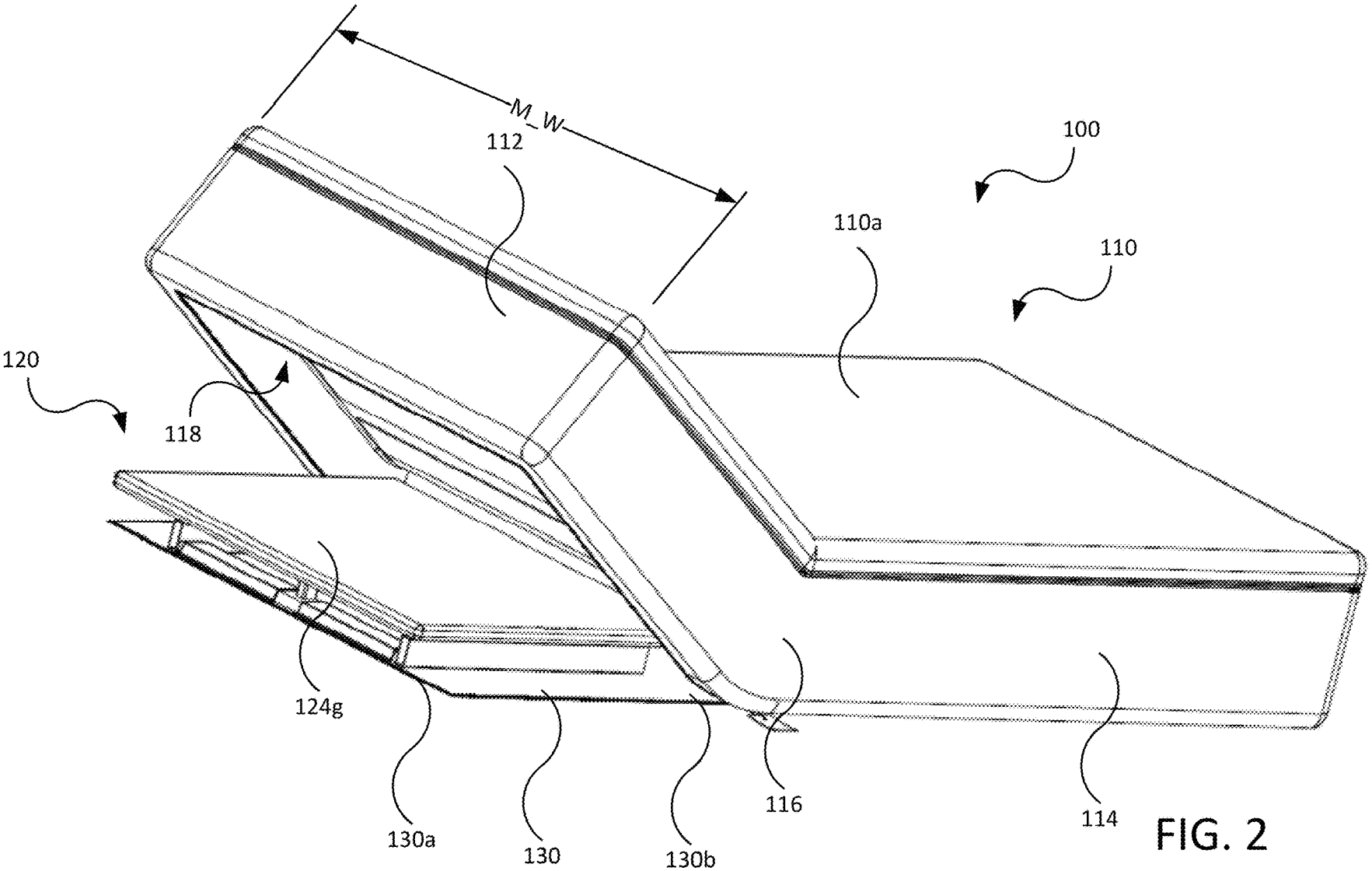
FIG. 2 is an upper, front, right perspective view of the adjustable bed system of FIG. 1 with the mattress in the inclined configuration and the adjustment mechanism thereof in a flat configuration.
Figure 3:
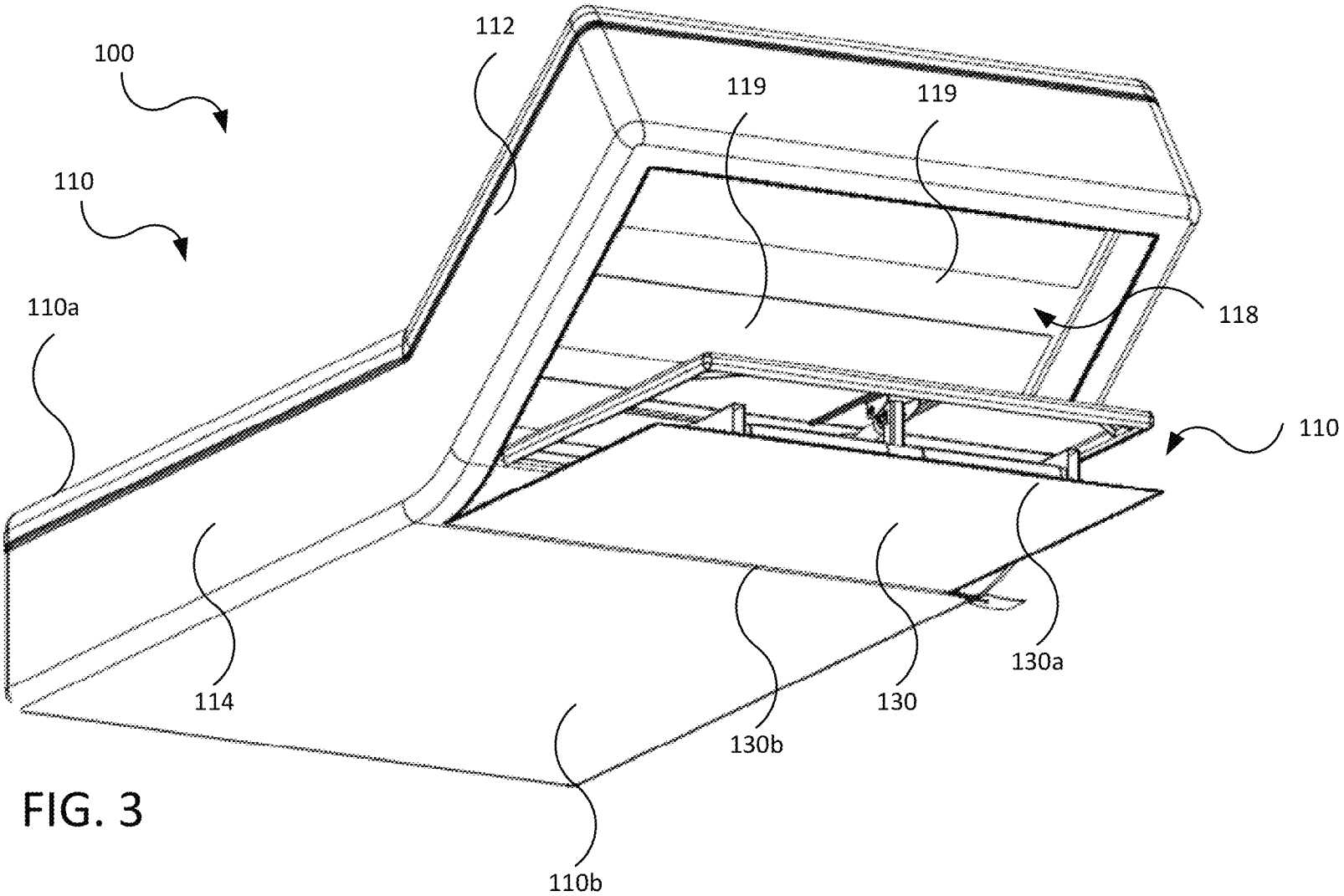
FIG. 3 is a lower, front, left perspective view of the adjustable bed system of FIG. 1 with the mattress in the inclined configuration and the adjustment mechanism in the flat configuration.
Figure 9:
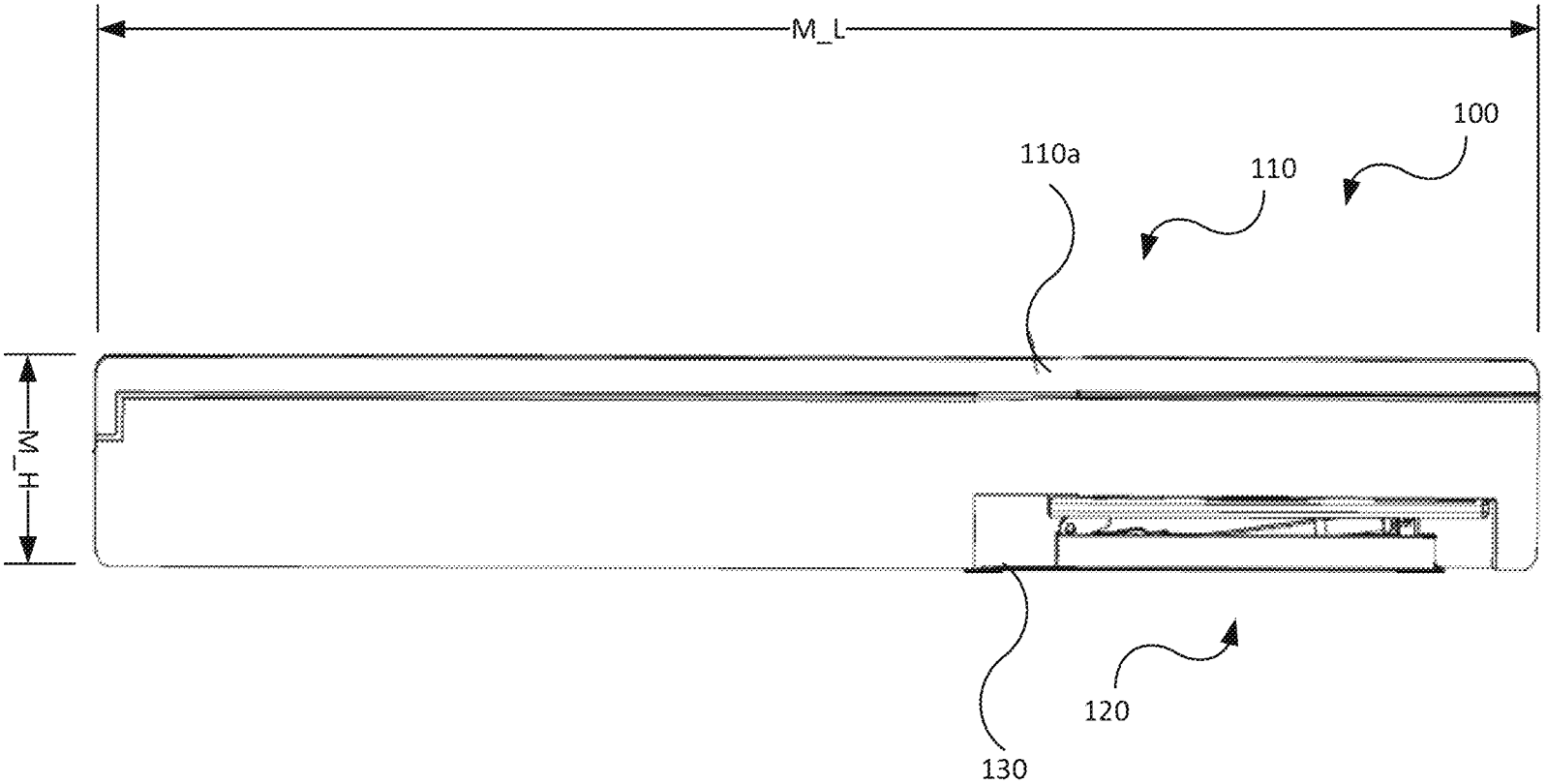
FIG. 9 is a side view of the adjustable bed system of FIG. 1 in the flat configuration with a partial cutaway of the mattress to illustrate the adjustment mechanism.

The mattress 110 is formed of one or more foam materials, such as urethane. In one example, the mattress 110 is monolithic with the foam material having generally uniform material properties throughout the head portion 112, the foot portion 114, and the central portion 116. In another example, the mattress 110 is polylithic with the foam material having different material properties within and/or between each of the head portion 112, the foot portion 114, and the central portion 116. In one example, the mattress 110 may decrease in stiffness and/or density moving upward. In yet another example, the mattress 110 is at least partially formed of a hybrid construction with different resilient and compressible materials, such as memory foam, poly-foam, gel, organic batting, latex, or spring coils. In the case of spring coils, the spring coils may be pocket coils (e.g., enclosed in a sheath or other flexible cover or housing) that are embedded in the foam of the mattress 110 (e.g., the foam being formed therearound). As shown in FIGS. 2 and 9, the mattress 110 has a height M_H that extends vertically between the upper surface and a lower surface of the mattress 110, a width M_W that extends left-to-right between left and right sides of the mattress 110, and a length M_L that extends longitudinally between head and foot ends of the mattress 110. The mattress 110 may be a standard size (e.g., twin, extended twin, full or double, queen, king) and, thereby, be a rectangular cuboid with the height M_H, width M_W, and length M_L of the mattress 110 being substantially uniform.

The mattress 110 further defines a cavity 118 in the head portion 112 in which the adjustment mechanism 120 is positioned. The cavity 118 is downwardly-open, such that the adjustment mechanism 120 may protrude from a bottom surface of the mattress 110. The cavity 118 may be formed during molding of the mattress 110 or by removing material.

For example, the head portion 112 includes an upper subportion 112*a* and a lower subportion 112*b* (distinction indicated in FIG. 1 by the dash-dot line) that include surfaces that cooperatively define the cavity 118. The upper subportion 112*a* may have a height U_H (see, e.g., FIG. 15). For example, the upper subportion 112*a* of the head portion 112 forms a down-facing surface that defines an upper end of the cavity 118. The height U_H of the upper subportion 112*a* above the cavity 118 may, for example, be approximately four inches, more or less in a relaxed state. The lower subportion 112*b* of the head portion 112 includes a left lower subportion 112*b*-1, a right lower subportion 112*b*-2, a head-end lower subportion 112*b*-3, and a foot-end lower subportion 112*b*-4 that, respectively, form right-facing, left-facing, foot-facing, and head-facing surfaces that, respectively, define left, right, head, and foot ends of the cavity 118. As referenced above, the mattress 110 may be polylithic, which may include the lower subportions 112*b*-1, 112*b*-2, 112*b*-3, and 112*b*-4 (i.e., which define the cavity 118) being stiffer and/or denser than interior and/or exterior subportions of the foot portion 114 (e.g., at common heights). As illustrated, the various surfaces of the upper subportion 112*a* and the lower subportion 112*b* that define the cavity 118 may be substantially planar and substantially perpendicular to each other, such that the cavity 118 is a rectangular cuboid.

As referenced above, the mattress 110 may also include coil springs (e.g., pocketed coil springs; not shown), which may be positioned in the upper subportion 112*a* of the head portion 112 vertically above the cavity 118. The foot portion 114 may also include coil spring in which case, those coil springs may have a different height (e.g., being taller) and/or material properties (e.g., stiffness) than those in the upper subportion 112*a* of the head portion 112.

Figure 6:
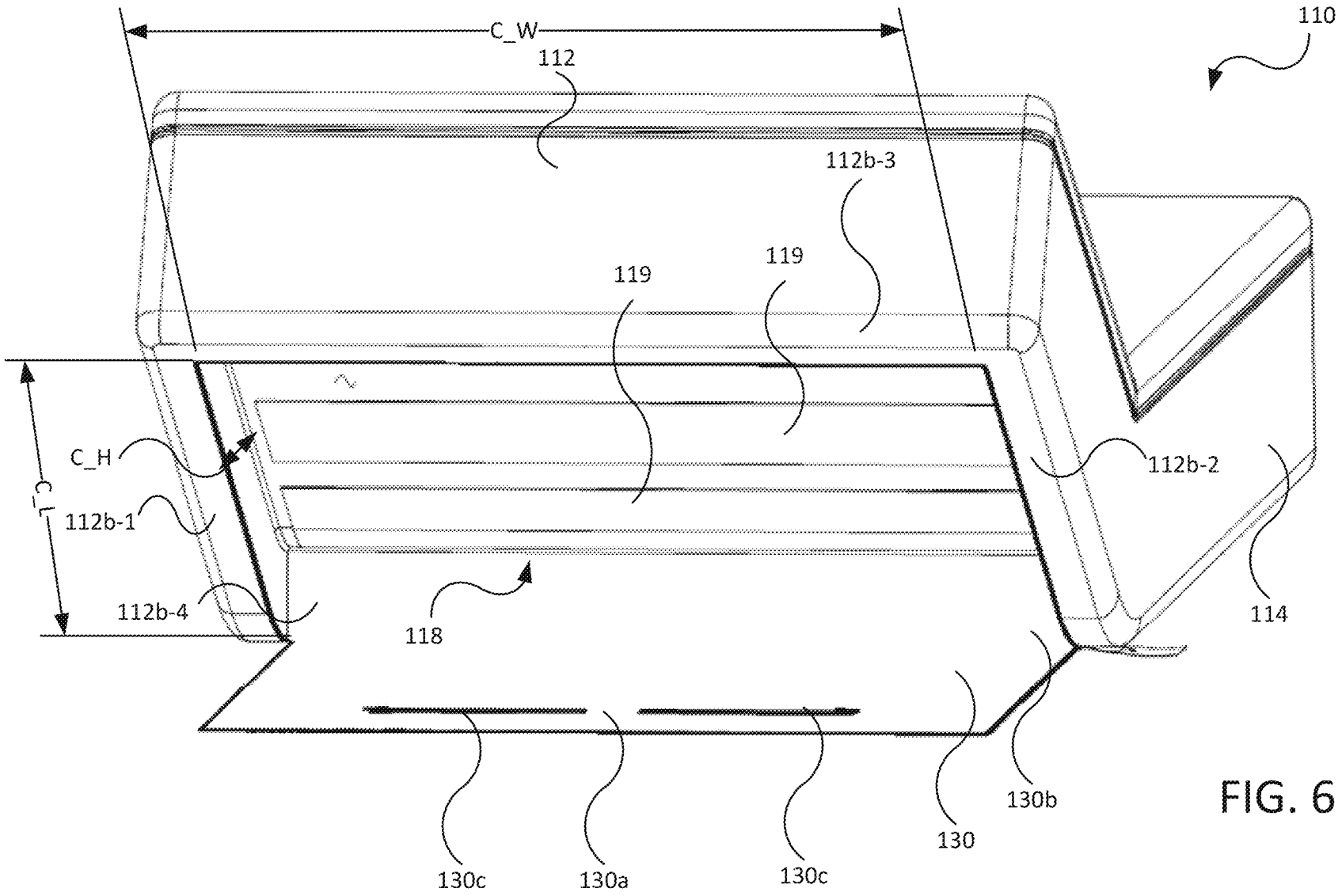
FIG. 6 is an upper, front, right perspective view of the mattress of FIG. 1 in the inclined configuration.
Figure 7:
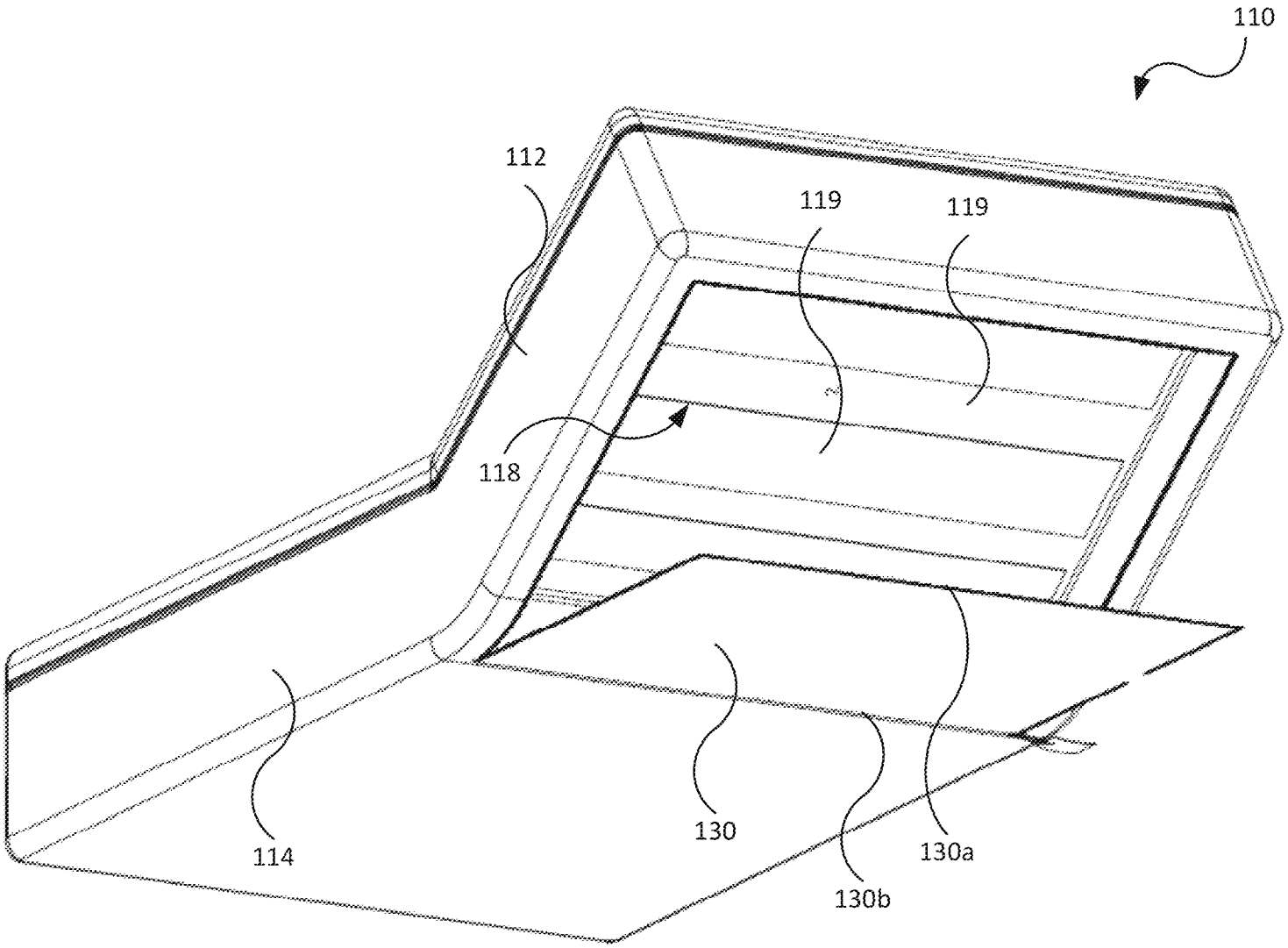
FIG. 7 is a lower, front, left perspective view of the mattress of FIG. 1 in the inclined configuration.
Figure 8:
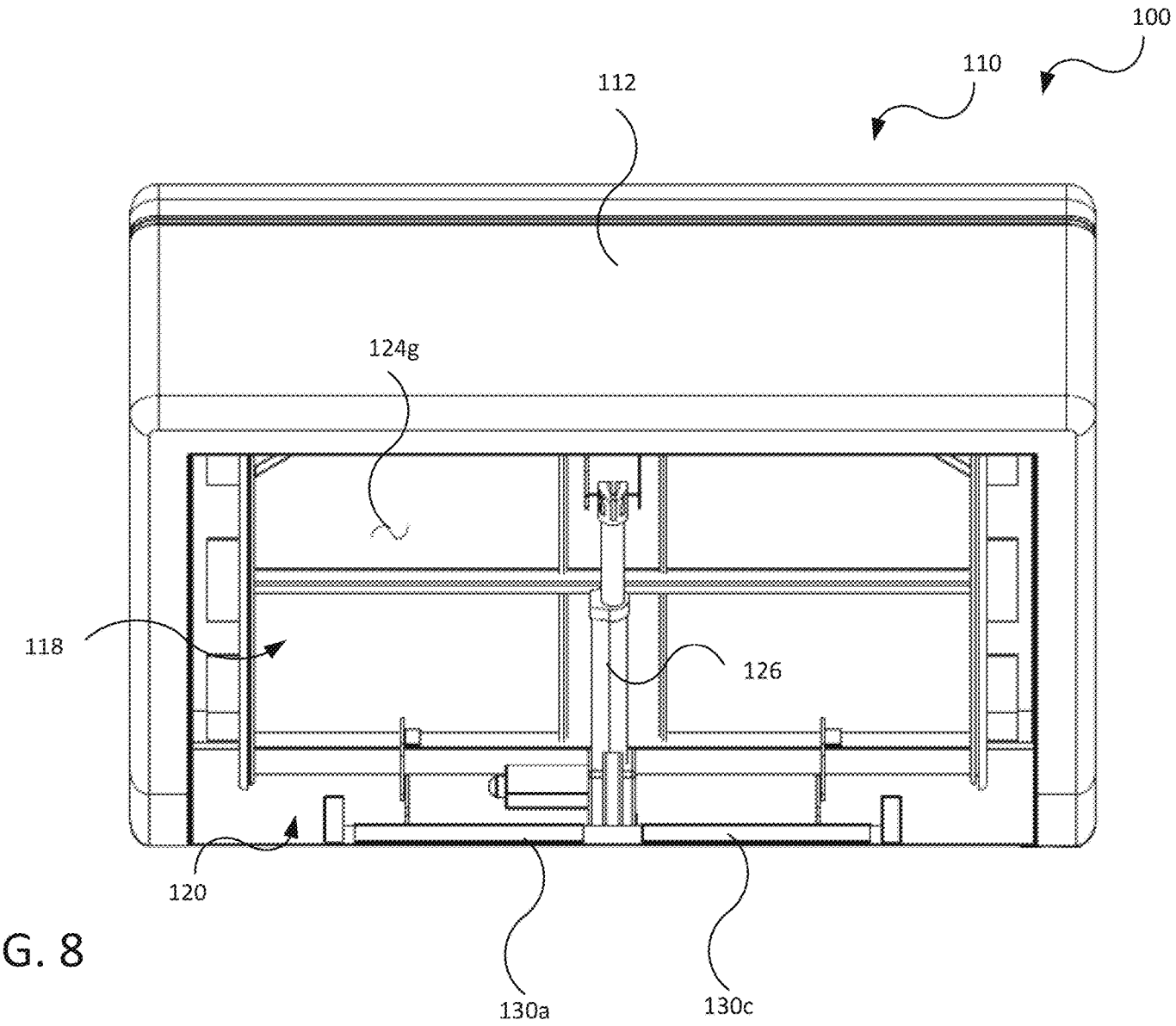
FIG. 8 is a rear view of the mattress of adjustable bed system of FIG. 1 in the inclined configuration.

As shown in FIG. 6, the cavity 118 may be considered to have a cavity height C_H that extends from the downward-facing surface of the upper subportion 112*a* of the head portion of the mattress 110 (i.e., surrounding the cavity), a cavity width C_W that extends left-to-right between the right- and left-facing surfaces of the left lower subportion 112*b*-1 and the right lower subportion 112*b*-2, and a cavity length C_L that extends longitudinally between the foot- and head-facing surfaces of the head-end lower subportion 112*b*-3 and the foot-end lower subportion 112*b*-4. The cavity length C_L may, for example, be between 15% and 45% (e.g., between 25% and 40%) of the mattress length M_L. In additional examples, the cavity length C_L may be less than 50% or between 30% and 50% of the mattress length M_L. The cavity width C_W may, for example, be between 80% and 100% (e.g., between 85% and 95%) of the mattress width M_W. In additional examples, the cavity width C_W may be greater than 60% or between 60% and 90% of the mattress width M_W.

The mattress 110 may further include one or more outer coverings. For example, the mattress 110 may include an upper covering 110*a*, such as a cover pad, that is coupled to and/or extends over an upper surface of the foam material forming the mattress 110. The mattress 110 may, instead or additionally, include a lower covering 110*b*, such as a woven material, that is coupled to (e.g., adhered to) and/or extends over a lower surface of the foam material forming the mattress 110. The lower covering 110*b* may also be referred to as a border fabric. The upper covering 110*a* and/or the lower covering 110*b* may further extend over vertical surfaces, or portions thereof, of the head end, foot end, and left and right sides of the mattress 110. The upper covering 110*a* and/or the lower covering 110*b* may be considered to form part of the head portion 112 and/or the foot portion 114 of the mattress 110. The lower covering 110*a* (e.g., the border fabric) may also line the cavity 118 (e.g., being adhered or otherwise coupled to the surfaces defining the cavity 118).

Figure 12:
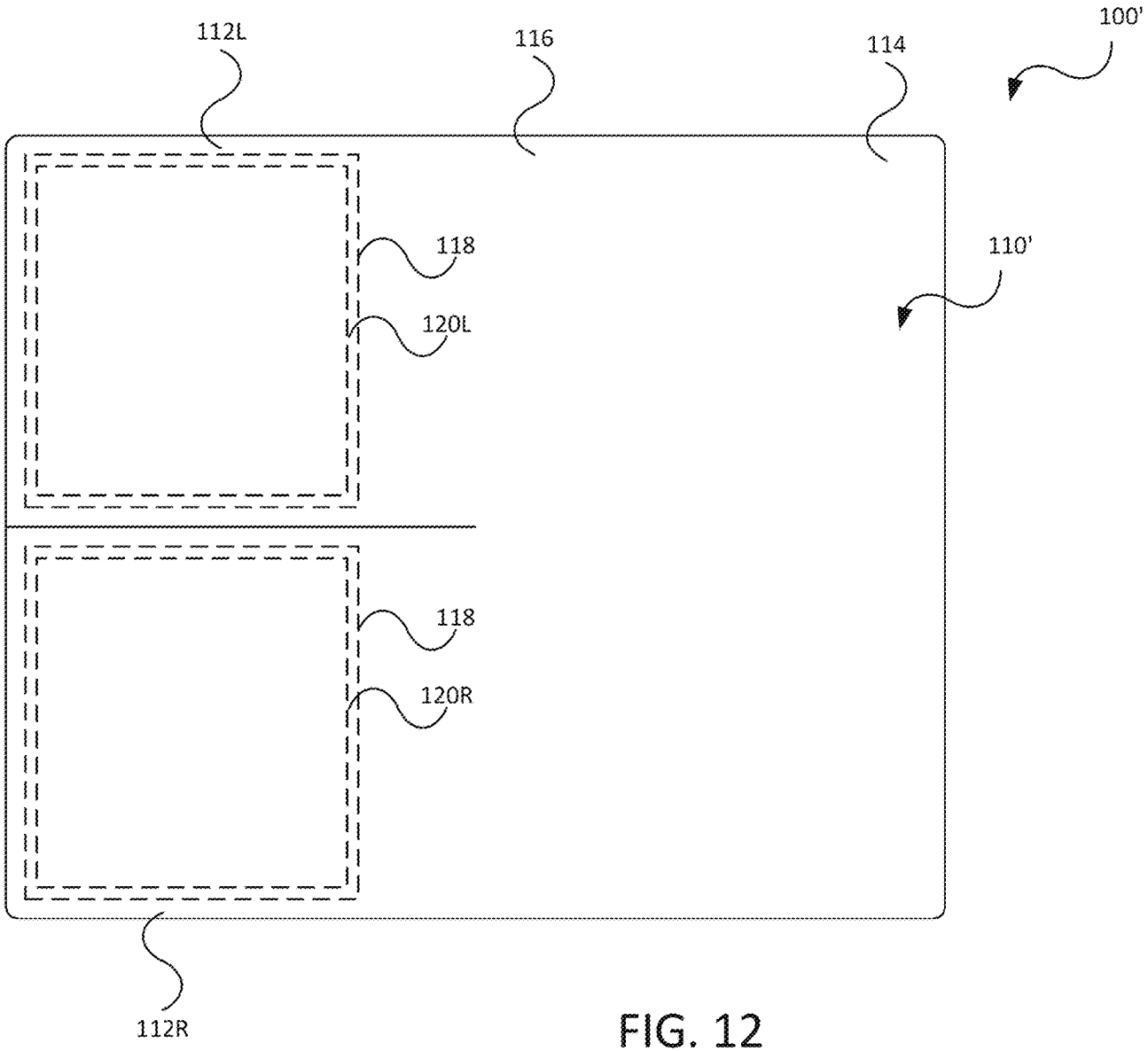
FIG. 12 is a top view of a third embodiment of the adjustable bed system with hidden features depicted in dashed lines.

Referring to FIG. 12, a variation of the adjustable bed system 100' is configured as a dual-position adjustable bed system to have two head portions that are movable independent of each other. In one example, the mattress 110' may be configured with left and right head portions 112L, 112R that are movable independent of each other and a singular foot portion 114 having left and right sides that are not movable independent of each other (e.g., are formed with continuous foam therebetween and/or have another type of connection therebetween). The adjustable bed system 100' includes a first adjustment mechanism 120L (e.g., a left adjustment mechanism) and a second adjustment mechanism 120R (e.g., a right adjustment mechanism), which are positioned in cavities 118 of the left and right head portions 112L, 112R of the mattress 110'. The cavities 118 and the adjustment mechanisms 120L, 120R may be configured as substantially described elsewhere for the cavity 118 and the adjustment mechanism 120, including the coupler 130 (as further described below). In another example (not shown), the dual-position adjustable bed system may include two of the adjustable bed systems 100, which form left and right sides of the dual-position adjustable bed system and include head portions that are adjustable independent of each other (i.e., each having one of the mattresses 110 and one of the adjustment mechanisms 120). In such case, the mattresses 110 and/or the adjustment mechanisms 120 of the left and right sides may be coupled to each other prevent relative longitudinal and/or lateral movement therebetween.

Figure 13:
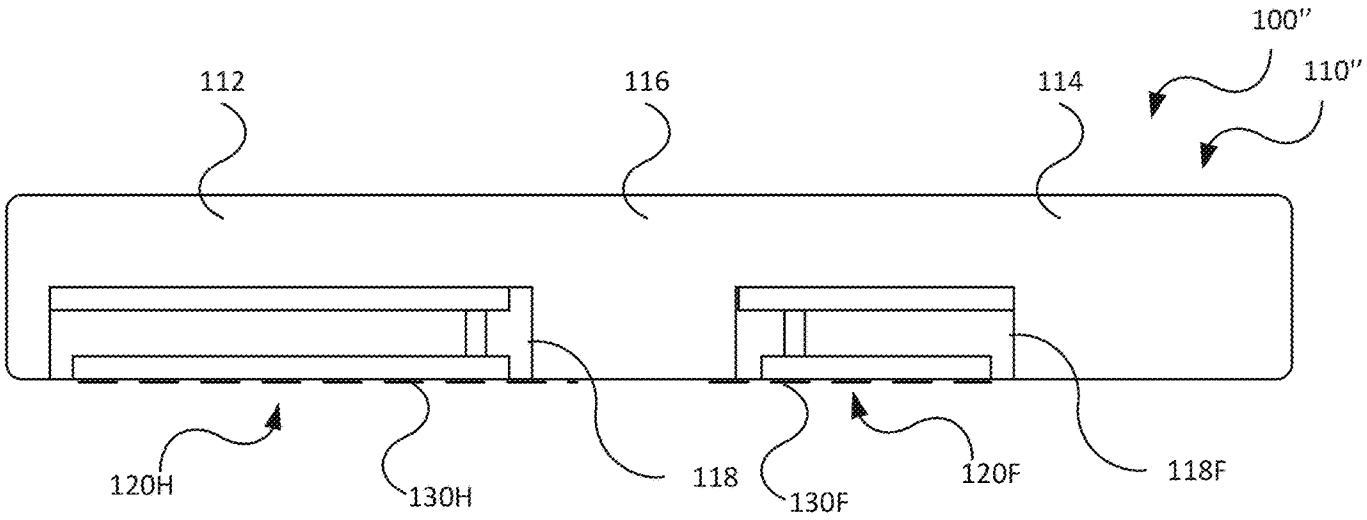
FIG. 13 is a side, partial cutaway view of a fourth embodiment of the adjustable bed system in a flat configuration.
Figure 14:
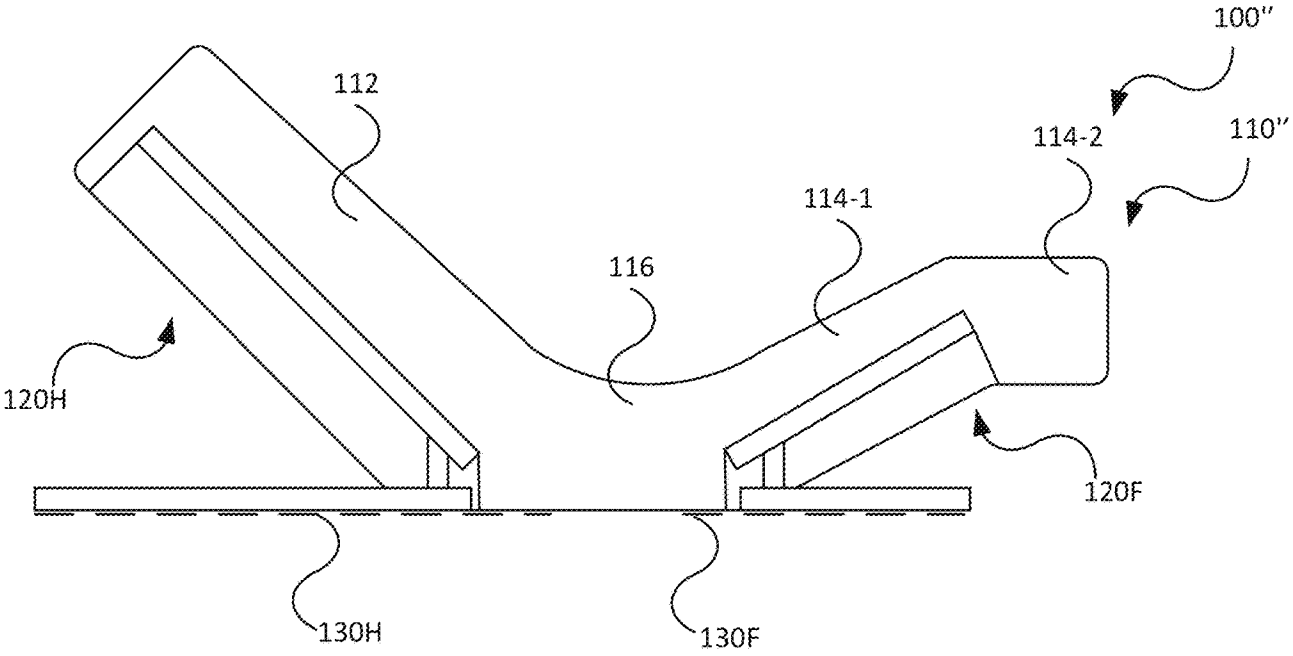
FIG. 14 is a side, partial cutaway view of the adjustable bed system of FIG. 13 with head and foot portions in inclined configurations.

Referring to FIGS. 13 and 14, another variation of the bed system 100" includes a mattress 110", a first adjustment mechanism 120H (e.g., a head adjustment mechanism) at the head portion 112 of the mattress 110", and a second adjustment mechanism 120F (e.g., a foot adjustment mechanism) at the foot portion 114 of the mattress 110". The mattress 110" and the first adjustment mechanism 120H are configured as described elsewhere for the mattress 110 adjustment mechanism 120, for example, with the mattress 110" defining a cavity 118 in which is positioned the first adjustment mechanism 120H that is configured to move the head portion 112 of the mattress 110 between the flat configuration and the inclined configuration. The mattress 110" is further configured to include a second cavity 118F in which is positioned the second adjustment mechanism 120 with the second adjustment mechanism 120F being configured to move a portion of the foot portion 114 of the mattress 114 between the flat configuration and an inclined configuration. More particularly, the second adjustment mechanism 120F supports and is configured to lift (e.g., incline) a portion (e.g., a thigh portion 114-1) of the mattress 110" that generally corresponds to the thigh of a user, while a distal portion (e.g., a distal foot portion 114-2) of the mattress 110" hangs from the second adjustment mechanism 120H and is otherwise unsupported by the second adjustment mechanism 120F. The cavity 118F and the second adjustment mechanism 120F may be generally as described for the cavity 118 and the adjustment mechanism 120, while having a shorter longitudinal length and/or distance over which the mattress 110" is engaged thereby. The intermediate portion 116 of the mattress 116 is positioned longitudinally between the first adjustment mechanism 120H and the second adjustment mechanism 120F and is configured to remain engaged with the support surface (e.g., foundation or platform) as each of the first adjustment mechanism 120H and the second adjustment mechanism 120F are moved between the flat and inclined configurations thereof.

Further interaction between the mattress 110 and the adjustment mechanism 120 and related features are discussed in further detail below.

Figure 4:
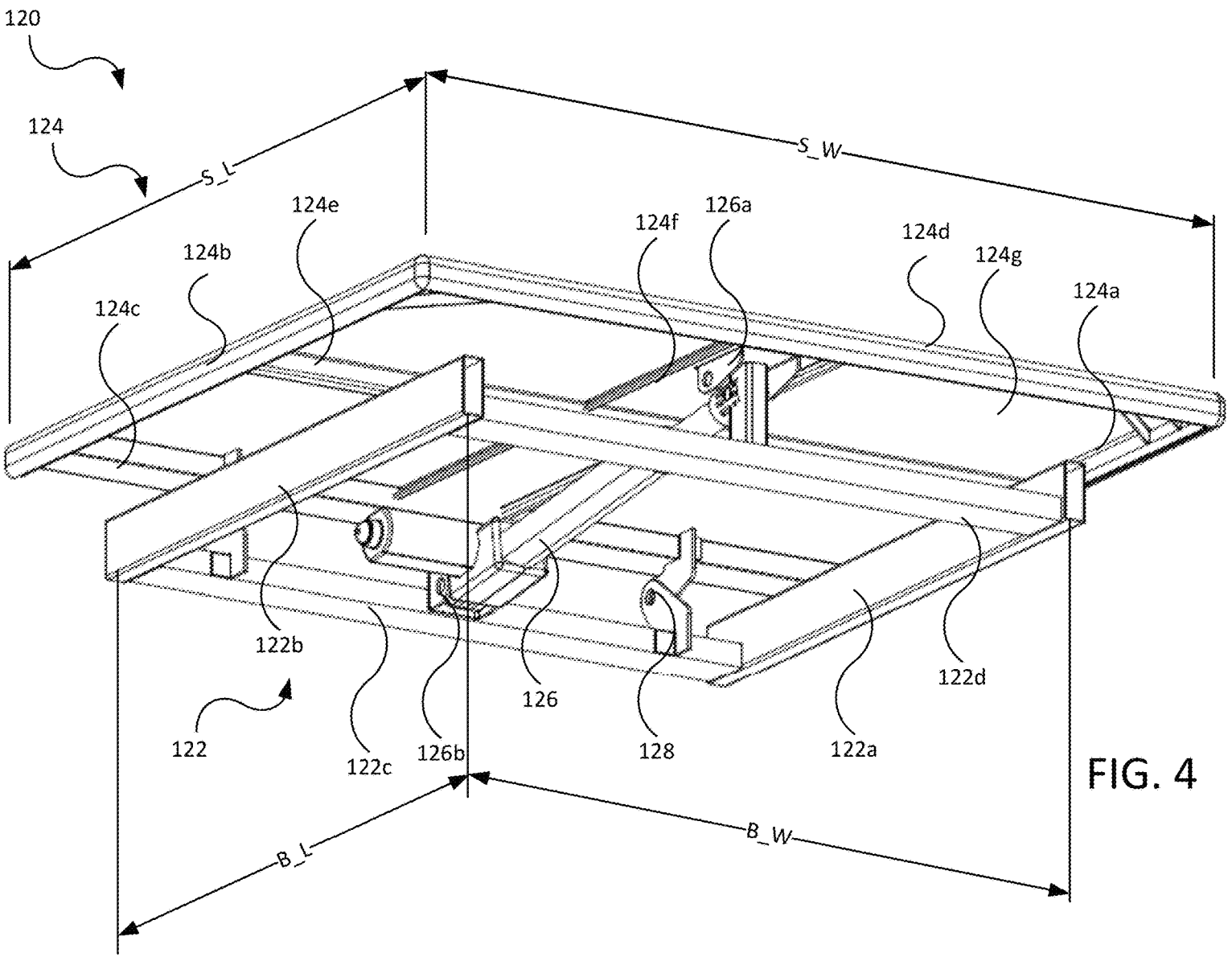
FIG. 4 is a lower, front, left perspective view of the adjustment mechanism of FIG. 1 in the flat configuration.
Figure 5:
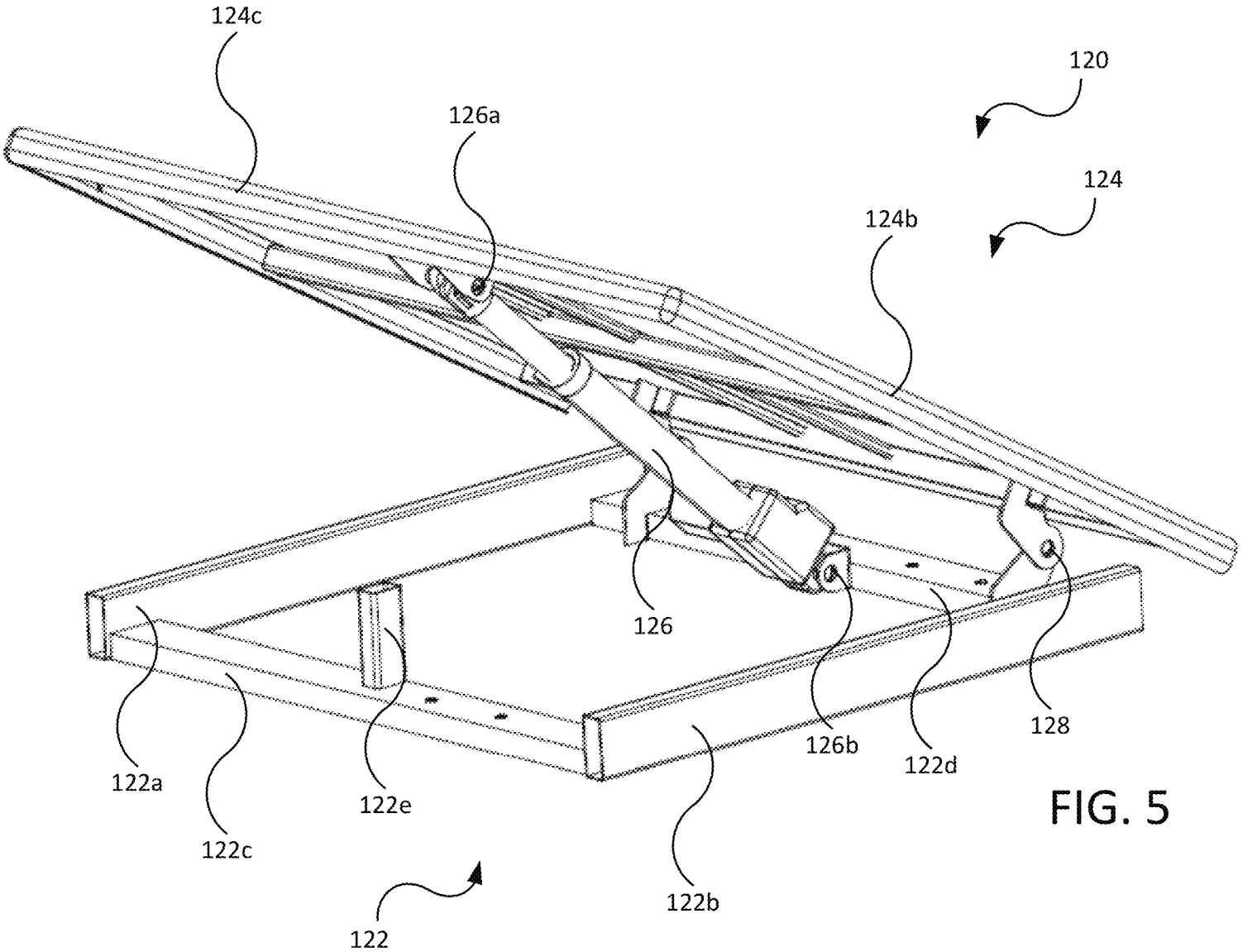
FIG. 5 is an upper, front, right perspective view of the adjustment mechanism in the inclined configuration.

Referring additionally to FIGS. 4 and 5, the adjustment mechanism 120 generally includes a lower base 122, an upper support 124 that is movable relative to the lower base 122, and an actuator 126 that is operable to move the upper support 124 relative to the lower base 122 and, thereby, move the mattress 110 between the flat and inclined configurations. The adjustment mechanism 120 and the cavity 118 of the mattress 110 are cooperatively configured for the adjustment mechanism 120 to be positioned within the cavity 118, for example, being substantially (e.g., entirely) contained within the cavity 118 when in the flat configuration and the collapsed configuration and partially contained within the cavity 118 (i.e., partially protruding from the cavity) when in the inclined configuration.

The lower base 122 is configured to be supported by the flat support surface (e.g., a floor or bed foundation) on which the adjustable bed system 100 is also positioned and to stably support the upper support 124 and the head portion 112 of the mattress 110 thereabove. For example, the lower base 122 of the adjustment mechanism 120 and a lower surface of the foot portion 114 of the mattress 110 may rest on the same flat support surface. The lower base 122 has a lower base width B_W and a lower base length B_L over which the lower base 122 engages or otherwise transfers force to the flat support surface, which may, for example, be 65% to 95% (e.g., 70% to 90%) of the cavity width C_W and the cavity length C_L, respectively. The lower base 122, which transfers vertical force to the support surface, may be positioned entirely forward of the foot portion 114 and/or the intermediate portion 116 of the mattress 110 or other portions of the mattress that remain supported by the support surface (e.g., engaged directly or indirectly therewith). For example, the adjustable bed system 100 may not include any rigid component that extends from the adjustment mechanism 120 rearward to the foot portion 114 and/or the intermediate portion 116 of the mattress 110 (e.g., above the bottom surface of the mattress 110, such as the bottom cover 110*b*).

The lower base 122 may be configured as a rectilinear frame. For example, the lower base 122 may generally include left and right side members 122*a*, 122*b* that are spaced apart (e.g., forming the lower base width B_W and/or extending parallel with each other in the longitudinal direction) and head-end and foot-end members 122*c*, 122*d* that are spaced apart, extending between and coupled to the left and right side members 122*a*, 122*b* (e.g., extending parallel with each other in the left-to-right direction). Each of the members 122*a*, 122*b*, 122*c*, 122*d* may, for example, be formed of steel, other metal, or other rigid material.

The lower base 122 may further include a stanchion 122*e*. The stanchion 122*e* is positioned on the head-side of the lower base 122 and protrudes upward to engage and, thereby, support the upper support 124 when in the flat configuration. For example, the stanchion 122*e* may be centrally located within the lower base width B_W and/or protrude upward from the head-end member 122*c* of the frame of the lower base 122.

The upper support 124 is configured to support and move the head portion 112 of the mattress 110 relative to the lower base 122 and, thereby, the flat support surface therebelow, between the flat configuration and the inclined configuration. The upper support 124 has an upper support width S_W and an upper support length S_L over which the upper support 124 engages or otherwise transfers force to the head portion 112 of the mattress, which may, for example, be greater than the lower base width B_W and the lower base length B_L, respectively, and be between 80% and 100% (e.g., between 90% and 100%) of the cavity width C_W and the cavity length C_L, respectively.

The upper support 124 is movably coupled to the lower base 122 and is movable relative thereto in a predetermined path. For example, as shown, the upper support 124 is pivotably coupled to the lower base 122 and is pivotable relative thereto around a pivot axis. In the example shown, a foot-end of the upper support 124 is pivotably coupled to the lower base 122 with a hinge 128 having the pivot axis, which may be positioned generally above the lower base 122 (e.g., the frame thereof) and below the upper support (e.g., the frame thereof, as discussed in further detail below). For example, the hinge 128 may be coupled to the foot-end member 122*d* of the lower base 122. Alternatively, the upper support 124 may be movable coupled to the lower base 122 in another manner, such as with a four bar linkage, for example, in which a head-side of the upper support 124 has a larger range of motion relative to the lower base 122 than a foot-side of the upper support 124.

The upper support 124 may be configured as a rectilinear frame. For example, the upper support 124 may generally include left and right side members 124*a*, 124*b* that are spaced apart (e.g., forming the upper support width S_W and/or extending parallel with each other in the longitudinal direction) and head-end and foot-end members 124*c*, 124*d* that are spaced apart, extending between and coupled to the left and right side members 124*a*, 124*b* (e.g., extending parallel with each other in the left-to-right direction). The upper support 124 may further include one or more intermediate members, for example, a lateral member 124*e* that extends left-to-right between and is coupled to the left and right side members 124*a*, 124*b* and/or a longitudinal intermediate member 124*d* that extends longitudinally between and is coupled to the head-end and the foot-end members 124*c*, 124*d*.

As referenced above, the foot-end of the upper support 124 is pivotably coupled to the lower base 122 with the hinge 128. For example, the hinge 128 may be coupled to the foot-end member 124*d* with the pivot axis thereof being positioned therebelow (e.g., below each of the members 124*a*, 124*b*, 124*c*, 124*d*). Each of the members 124*a*, 124*b*, 124*c*, 124*d*, 124*e*, and 124*f* may, for example, be formed of steel, other metal, or other rigid material.

The actuator 126 is configured to selectively move the upper support 124 relative to the lower base 122. For example, as shown, the actuator 126 may be a linear actuator having a first end that is pivotably coupled to a head-side of the upper support 124 and having a second end that is pivotably coupled to a foot-side of the lower base 122. As the actuator 126 is selectively extended and retracted, the upper support 124 is moved relative to the lower base 122, so as to move the head portion 112 of the mattress 110 toward the inclined configuration and the flat configuration, respectively. The actuator 126 may, for example, be or include a lead screw actuator, ball screw actuator, linear motor, or other type of linear actuator. In other examples, the actuator 126 may instead include an electric motor and gears, pulleys, belts, and/or chains by which force is transferred from the electric motor to raise the upper support 124 relative to the base 122. The actuator 126 may be controlled in any suitable manner, for example, by having a controller that interfaces with a control device (e.g., a remote control, a smartphone, or the like) or a simple switch that supplies power thereto.

As referenced above, a first end of the actuator 126 is pivotably coupled to the head-side of the upper support 124. For example, as shown, the first end of the actuator 126 may be pivotably coupled via a hinge 126*a* to the longitudinal intermediate member 124*f* of the upper support 124 proximate the head-end member 124*c*, or may instead be pivotably coupled with the hinge 126*a* to the head-end member 124*c*. A pivot axis of the hinge 126*a* may be positioned above the pivot axis of the hinge 128 and/or below the upper support 124 (e.g., the frame thereof).

As also referenced above, a second end of the actuator 126 is pivotably coupled to the foot-side of the lower base 122. For example, as shown, the second end of the actuator 126 may be pivotably coupled via hinge 126*b* to the foot-end member 122*d*. A pivot axis of the hinge 126*b* may be positioned below and/or forward of the pivot axis of the hinge 128 and/or in plane with the lower base 122 (e.g., the frame thereof).

The adjustment mechanism 120 may be coupled to the mattress 110 to prevent relative movement therebetween. The adjustment mechanism 120 is operable to pivot the head portion 112 of the mattress 100 upward from the flat configuration to the inclined configuration by pressing generally upward against the head portion 112 of the mattress and downward against the support surface (e.g., the bed frame or foundation) supporting the adjustable bed system 100. However, as the upper support 124 is inclined from the flat configuration to the inclined configuration, force from the head portion 112 acting on the upper support 124 changes from being vertical (e.g., straight downward with no horizontal force component) to acting in the forward direction. The changed direction of the force may tend to cause the head portion 112 of the mattress to slide downward along the upper support 124 toward the rearward end thereof and/or tend to push the adjustment mechanism 120 in the forward direction away from the mattress 110.

The upper support 124 of the adjustment mechanism 120 engages and/or may be coupled to the head portion 112 of the mattress to prevent movement therebetween, such as to prevent longitudinal or lateral sliding of the head portion 112 relative to the upper support 124. For example, the engagement or coupling of the upper support 124 to the head portion 112 prevents sliding of the head portion 113 downward along the upper support 124, such as when the adjustable bed system 100 is in, moving to, or moving from the inclined configuration.

In one example, the upper support 124 may include one or more support panels 124*g* that span substantially the upper support width S_W. For example, the one or more support panels 124*g* may be coupled to and extend between the left and right side members 124*a*, 124*b*. The one or more support panels 124*g* may be configured to distribute force from the upper support 124 to the mattress 110 (e.g., the upper subportion 112*a* of the head portion 112 thereof), for example, over a larger surface area than the frame of the upper support 124.

The one or more support panels 124*g* may instead or additionally be configured to positively couple to the mattress 110 (e.g., to the upper subportion 112*a* of the head portion 112 thereof) to prevent or limit relative movement therebetween. For example, the one or more support panels 124*g* may include a first connection feature, such as one side of a hook-and-loop fastener (e.g., the loop side or other material configured to couple to the hook-side) on upper surfaces thereof.

The mattress 110 may include one or more mattress panels 119 that are coupled to the downward-facing surface of the upper subportion 112*a* of the head portion 112 of the mattress 110 (i.e., surrounding the cavity), such as to the lower covering 110*b*. The mattress panels 119 include on a downward-facing surface thereof a second connection feature that is configured to engage the first connection feature of the upper support 124, such as the other side of the hook-and-loop fastener (e.g., the hook side). Additionally or alternatively, the mattress panels 119 may, for example, be adhered to the downward facing surface of the upper subportion 112*a* of the mattress 110. Further, in some examples, the mattress 110 or portions thereof may be molded to the one or more support panels 124*g*. The mattress panels 119 are arranged so as to be engaged by the support panels 124*g* when the adjustment mechanism 120 is positioned in the cavity 118 of the mattress 110. When the adjustment mechanism 120 is positioned in the cavity and the upper support 124 pressed against the downward facing surface of the head portion 112 of the mattress 110, the support panels 124*g* press against the mattress panels 119 to couple thereto and prevent relative movement therebetween (e.g., shear or sliding movement) and, thereby, between the upper support 124 of the adjustment mechanism 120 and the head portion 112 of the mattress 110.

In still further example, the mattress 110 may be configured to couple to the upper support 124 with straps that are coupled to the upper subportion 112*a* (e.g., to the lower cover 110*b* lining the cavity 118) and/or recesses in the upper subportion 112*a* which receive therein (e.g., further recessed relative to the cavity 118) or otherwise couple to the upper support 124 of the adjustment mechanism 120 (e.g., members of the frame thereof thereof). In still further examples, the clips, snaps, magnets, or other fasteners may couple the head portion 112 (e.g., the upper subportion 112*a*) of the mattress 110 to the upper support 124 of the adjustment mechanism 120. In yet a further example, the upper support 124 of the adjustment mechanism 120 may be embedded in the foam forming the mattress 110, for example, with the foam curing around the frame members and/or the support panels 124*g* (e.g., being formed of a mesh material).

The lower base 122 of the adjustment mechanism 120 may be coupled the mattress 110 to prevent movement of adjustment mechanism 120 in the forward direction relative to the mattress 110, for example, when the adjustable bed system 100 is in, moving to, or moving from the inclined configuration. More particularly, a coupler 130 couples the lower base 122 of the adjustment mechanism 120 to another portion of the mattress 110 to prevent the lower base 122 from moving in the forward direction away from other portions of the mattress 110 (e.g., the foot portion 114 thereof). The coupler 130, for example, be coupled at a forward end 130*a* to the lower base 122 and at a rearward end 130*b* to a coupling portion 110*c* of the mattress 110 that is rearward of the cavity 118 and/or that does not change or substantially change position relative to the support surface (e.g., the bed frame or foundation) or the foot portion 114 of the mattress 110 when the adjustable bed system 100 is moved between the flat configuration and the inclined configuration. The coupling portion 110*c* may, for example, be or otherwise include the foot portion 114 of the mattress 110 (e.g., a lower surface or portion thereof or the lower covering 110*b*) or may instead, or additionally, include the intermediate portion 116.

Referring again to FIGS. 13 and 14, in the case of the adjustable bed mechanism 100" that includes the first adjustment mechanism 120H and the second adjustment mechanism 120F, which correspond to the head portion 112 and the foot portion 114 of the mattress 110", respectively, one or more coupling portions 110*c* may include or be formed by the intermediate portion 116 of the mattress 110". For example, a first coupler 130H of the first adjustment mechanism 130 may be coupled to the intermediate portion 116 of the mattress 110", a second coupler 130H of the second adjustment mechanism 130 may be coupled to the intermediate portion 116 of the mattress 110" at the same or different coupling location 110*c*. Furthermore, a single coupler 130 may extend between and couple the first adjustment mechanism 120H to the second adjustment mechanism 120F (e.g., having a common panel extending therebetween).

Figure 10:
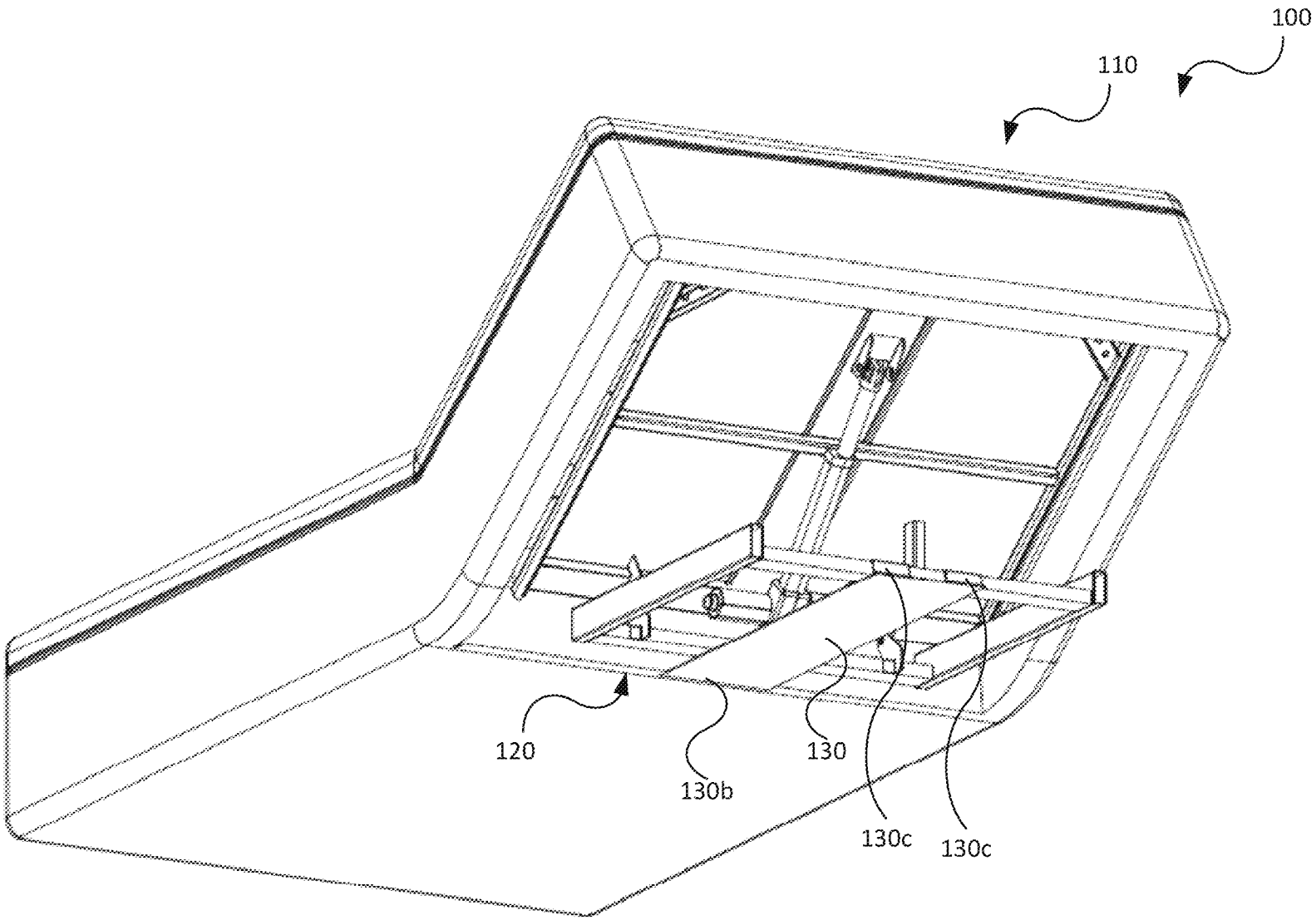
FIG. 10 is a lower, front, left perspective view of a second embodiment of a bed system in an inclined configuration.
Figure 11:
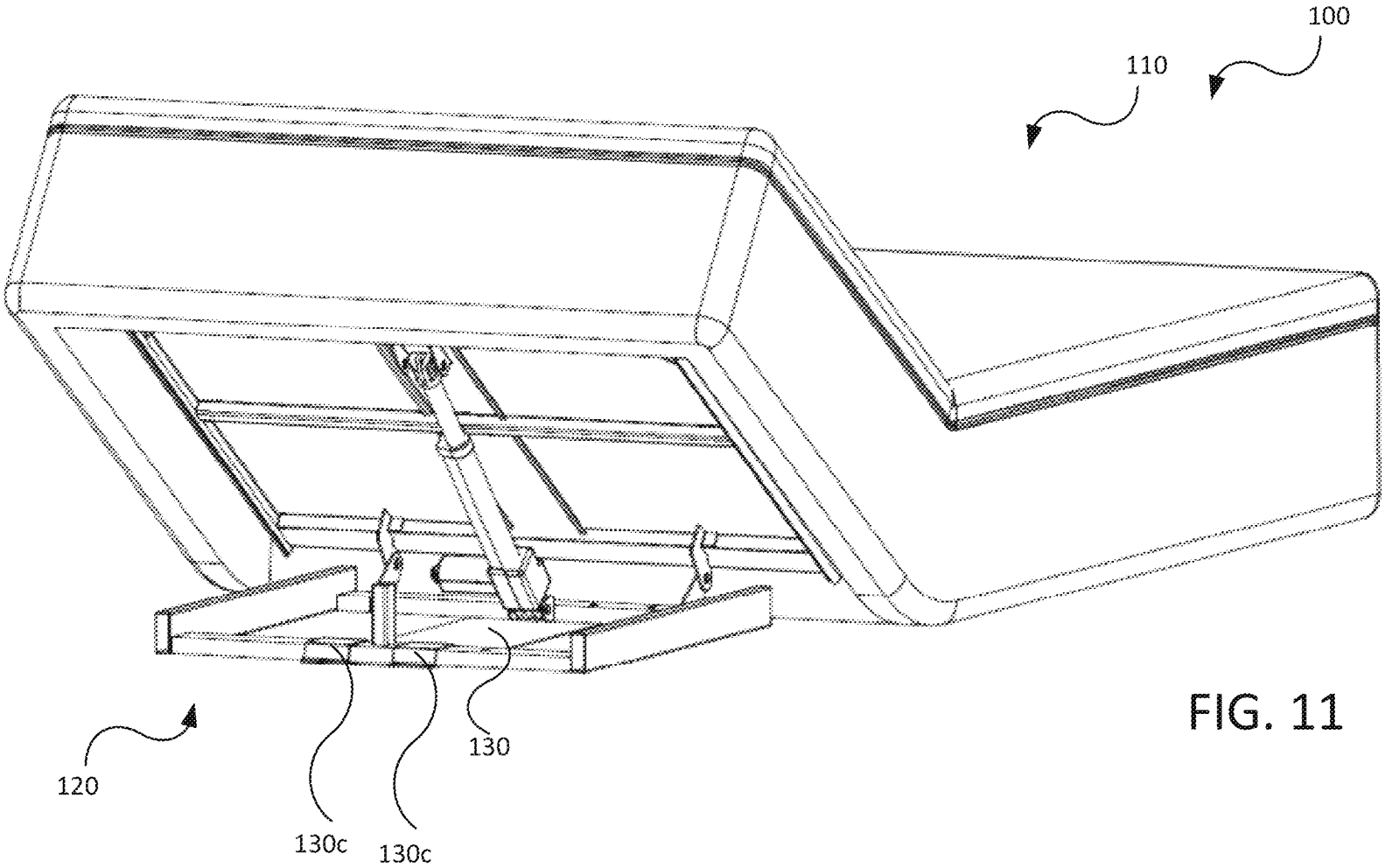
FIG. 11 is an upper, front, right perspective view of the adjustable bed system of FIG. 10 in the inclined configuration.

The coupler 130 may be or include one or more flexible panels. Each of the panels forms the forward end 130*a* and the rearward end 130*b* of the coupler 130 (i.e., disposed toward the head end and the foot end, respectively, of the adjustable bed system 100). For example, as shown in FIGS. 1-3 and 7, the coupler 130 is configured as a panel that spans the cavity width C_W of the cavity 118. As shown in FIGS. 10-11, the coupler 130 is configured as a panel that instead spans less than half the cavity width C_W of the cavity 118. In further configurations (not shown), the coupler 130 may include two or more of the flexible panels (e.g., straps) that are spaced apart and cooperatively form less than half the cavity width C_W of the cavity. The panels are made of a substantially inextensible material, so as to prevent forward movement of the lower base 122 relative to the foot portion 114 of the mattress 110, such as a woven nylon or other woven fabric.

The rearward end 130*b* of the coupler may be coupled to the mattress 110 in any suitable manner. For example, the panels of the coupler 130 may be formed continuously with the lower covering 110*b* (e.g., the rearward end 130*b* being continuous with the lower covering 110*b*) or may be coupled thereto (e.g., stitching, adhesive, or fastener, such as a zipper). Furthermore, the mattress 110 may include a reinforcement at the coupling location 110*c*, for example, including a material that is in addition to and/or stronger than the lower covering 110*b*, such as a nylon or ripstop material, which is coupled to the mattress 110 (e.g., adhered and/or sewn to the lower covering 110*b*) and to which the rearward end 130*b* of the coupler 130 is coupled thereto.

The forward end 130*a* of the panel is coupled to the lower base 122. For example, the forward end 130*a* be configured to wrap around the head-end member 122*c* (as shown) or the foot-end member and couple to itself with a suitable fastener (e.g., a zipper, as shown) and, thereby, couple the forward end 130*a* of the panel to the lower base 122. Alternatively, the forward end 130*a* of the panel may include one or more additional attachment panels that extend from the panel (e.g., are sewn or otherwise attached thereto) and be configured to wrap around the head-end member 122*c* or the foot-end member and couple to the panel with a suitable fastener (e.g., a zipper). For example, in the case of the frame of the lower base 122 including a centrally-positioned stanchion 122*e*, the panel (or the attachment panels) may wrap around the head-end member 122*c* on each side of the stanchion 122*e*. The panel of the coupler 130 may extend under the foot-end member 122*d* and may further extend under the head-end member 122*c* of the lower base when in the first, second, and third configurations.

The forward end 130*a* of the coupler 130 (e.g., the panel) may also be configured to releasably couple to the mattress 110 forward of the cavity 118, which may retain and/or partially or fully enclose the adjustment mechanism 120 within the cavity 118 when in the third configuration. When the forward end 130*a* of the coupler 130 is released from the mattress 110, the adjustment mechanism 120 may be operated, so as to move the adjustable bed system 100 toward the inclined configuration (e.g., such that the lower base 122 of the adjustment mechanism is at least partially outside of and/or below the cavity 118). For example, the forward end 130*a* may releasably couple to the mattress 110 (e.g., the lower covering 110*b* at the head end thereof) with a zipper or other suitable releasable coupling device (e.g., snaps, buttons, hook and loop fasteners). In the case of the coupler 130 being a panel that spans the cavity width C_W of the cavity 118, the left and right sides of the panel may be coupled to the mattress 110 laterally outward of the cavity 118 (e.g., with a zipper that extends around left, right, and front sides of the cavity 118, as shown in FIGS. 1-3 and 7).

Figure 15:
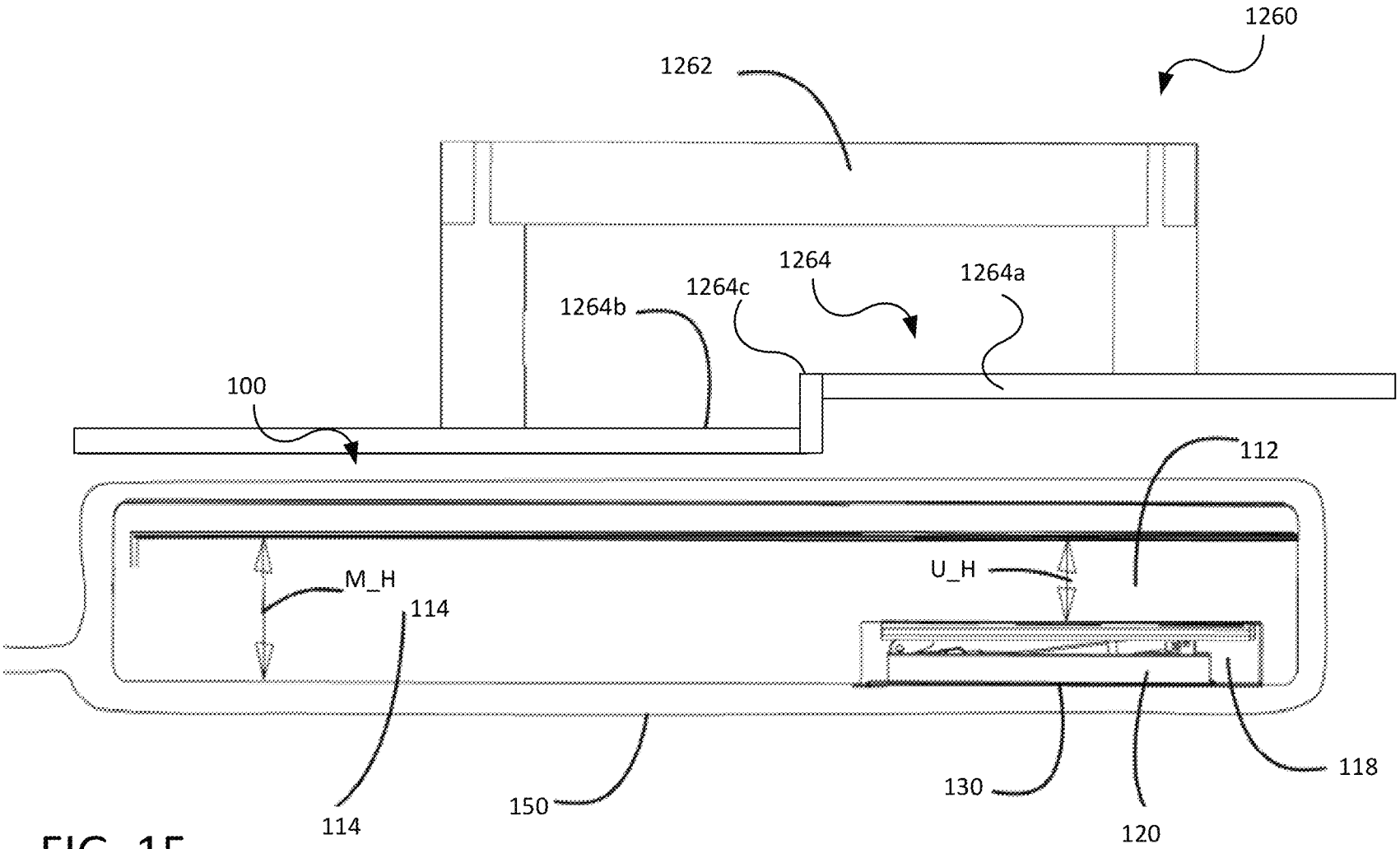
FIG. 15 is a side view of the adjustable bed system of FIG. 1 in a mechanical compression system in an uncompressed state.
Figure 16:
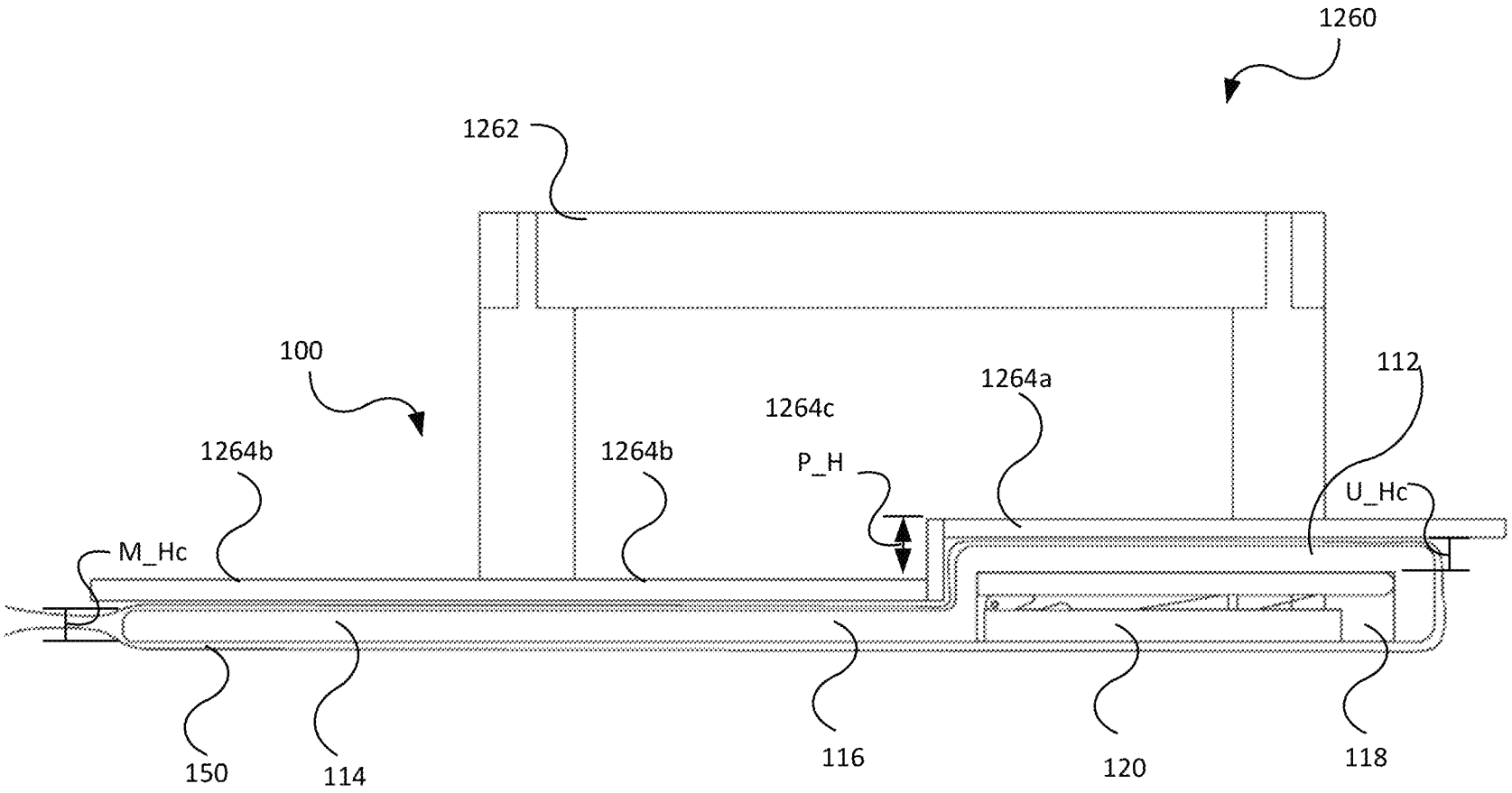
FIG. 16 is a side view of the adjustable bed system in the mechanical compression system of FIG. 15 in a compressed state.
Figure 17:
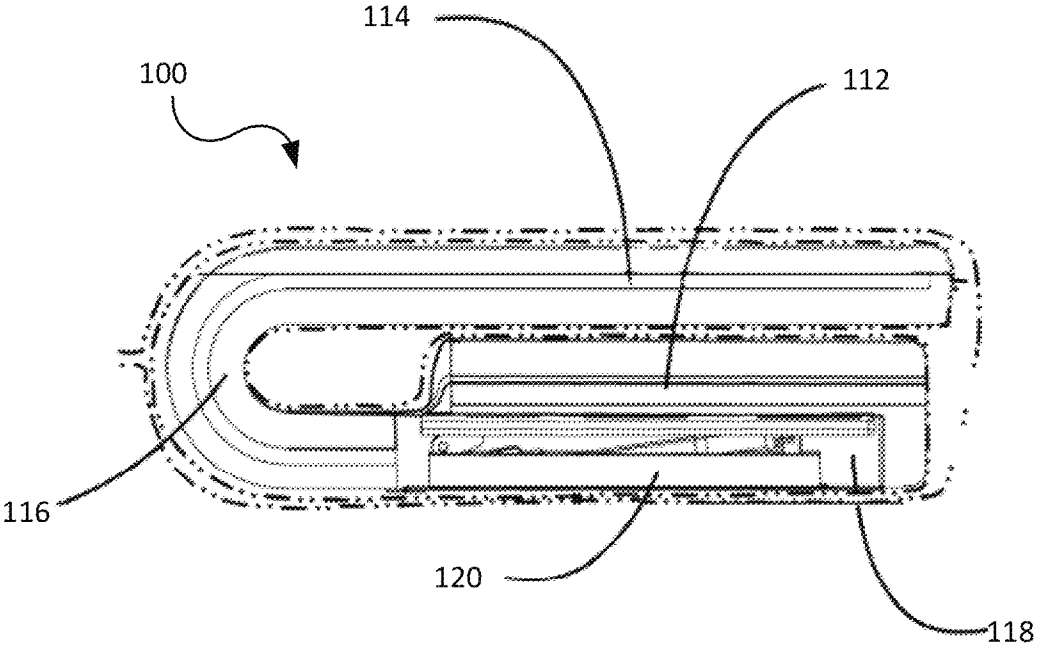
FIG. 17 is a side view of the adjustable bed system in a collapsed configuration.

Referring to FIGS. 15-17, as referenced above, the adjustable bed system 100 may be provided in a third configuration, for example, for shipping or storage. In the third configuration, the adjustment mechanism 120 is in the flat (e.g., collapsed configuration) and positioned in the cavity 118 of the head portion 112 of the mattress 110, and the foot portion 114 is folded over the head portion 112 such that upper surfaces thereof face each other.

Additionally, each of the head portion 112 and the foot portion 114 may be compressed (e.g., in the vertical direction), so as to reduce the volume of the head portion 112 and the foot portion 114 relative to relaxed states thereof. The head portion 112 and the foot portion 114 may be compressed by different amounts relative to their dimensions in the relaxed states, for example, with the head portion 112 being compressed less than the foot portion 114 in absolute measures and relative to the overall mattress height M_H. For example, with the mattress 110 having a substantially constant mattress height M_H over the mattress width M_W and mattress length M_L and with the adjustment mechanism 120 being substantially incompressible in the vertical direction, the foam forming the head portion 112 (e.g., the upper subportion 112*a* thereof) of the mattress 110 is thinner than that forming the foot portion 114, such that equally applied force (e.g., pressure) will result in the head portion 112 compressing a lesser amount than the foot portion 114. The foam forming each of the upper subportion 112*a* of the head portion 112 and the foot portion 114 may, for example, be compressed up to a maximum allowable compression factor, such as approximately 50% of the thicknesses thereof.

The head portion 112 and the foot portion 114 of the mattress 110 may retained in the compressed states with removable packaging 150, for example, being vacuum sealed in the packaging 150 (e.g., a vacuum bag). The adjustment mechanism 120 is contained in the packaging 150 (e.g., being under vacuum).

The adjustable bed system 100 may be placed into the third configuration (e.g., packaged) in different manners. In either example described below, the adjustment mechanism 120 is inserted into the cavity 118 of the mattress and the coupler 130 is coupled to the lower base of the adjustment mechanism (e.g., by wrapping the coupling panel 130*c* around the head-end member 122*c* and coupling to itself with a zipper, and the coupling panel 130*c* may be further releasably coupled to the mattress 110 forward of and/or to the sides of the cavity 118, such as with a zipper). The adjustable bed system 100 is subsequently compressed and maintained in compression.

In a first example, the adjustable bed system 100 is compressed and retained in compression using a vacuum. The adjustable bed system 100 is placed into the packaging 150 (i.e., the vacuum bag), a vacuum is drawn in the packaging 150 to compress the mattress 110, and the packaging is sealed 150 to hold the vacuum.

In a second example, the adjustable bed system 100 is compressed mechanically and retained in compression using a vacuum. The adjustable bed system 100 is placed into the packaging 150 (i.e., the vacuum bag), the head portion 112 and the foot portion 114 of the mattress 110 are compressed mechanically different distances, a vacuum is drawn in the packaging 150 concurrent with or after mechanical compression, and the packaging 150 is sealed to hold the vacuum and maintain the mattress 110 in compression.

To mechanically compress the adjustable bed system 100, a plate compression system 1260 may be used. In one example, the plate compression system 1260 includes a press 1262 that presses a singular planar plate (not shown) downward against upper surfaces of the head portion 112 and the foot portion 114 of the mattress 110 to compress the head portion 112 and the foot portion 114 by a common distance. The press 1262 of the plate compression system 1260 may be operated, for example, hydraulically, pneumatically, or with weights and gravity. In a second example, the press 1262 presses a stepped plate 1264 (e.g., with common pressure) or multiple plates (e.g., with common or differential pressure) downward against upper surfaces of the head portion 112 and the foot portion 114 of the mattress 110. The stepped plate 1264 includes a head plate 1264*a* at a first elevation, a foot plate 1264*b* at a second elevation lower than the first elevation, and a transition portion 1264*c* extending between the head plate 1264*a* and the foot plate 1264*b*. The press 1262 presses the stepped plate 1264 against the mattress 110 over a stroke distance that is greater than both a compression distance of the foot portion 114 and a difference P H between the first and second elevations of the head plate 1264*a* and the foot plate 1264*b*. As a result of the different elevations of the head plate 1264*a* compressing the head portion 112 and the foot plate 1264*b* compressing the foot portion 114 of the mattress 110, the plate compression system 1260 compresses the head portion 112 than the foot portion 114 by different amounts (i.e., the head portion 112 being compressed a lesser distance than the foot portion 114). Furthermore, the stepped plate 1264 may be configured such that a compressed height M_Hc of the foot portion 114 of the mattress 110 and a compressed height U_Hc of the upper subportion 112*a* of the head portion 112 of the mattress 110 are substantially equal.

Whether compressing the mattress 110 with a vacuum or mechanically, upon sealing the packaging 150 to maintain the vacuum and the mattress 110 in compression, the mattress 110 may then be folded about the central portion 116 over the head portion 112 and retained in the folded state with additional packaging, such as a bag into which the packaging 150 is inserted (e.g., with or without a further vacuum) or banding. In the case of the adjustable bed system 100 including two of the adjustment mechanisms 120 at the head portion 112, the adjustable bed system 100 may additionally be folded about a longitudinal axis of the mattress 110 (i.e., between the two adjustment mechanisms 120 and the left and right sides of the mattress 100).

In order to subsequently use the adjustable bed system 100, the packaging 150 is removed and the forward end 130*a* of the panel is decoupled from the mattress 110 to allow the adjustment mechanism 120 to raise the head portion 112 of the mattress 110 relative the lower base 122 and flat support surface thereunder.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed:

1. An adjustable bed system comprising:

a mattress having a head portion and a foot portion rearward of the head portion, wherein the head portion defines a cavity that is downwardly open;

an adjustment mechanism having a lower base, an upper support that is movably coupled to the lower base, and an actuator operable to move the upper support relative to the lower base; and a flexible panel, a zipper, or both that couple the lower base of the adjustment mechanism to a coupling portion of the mattress rearward of the cavity to prevent forward movement of the adjustment mechanism relative to the foot portion of the mattress;

wherein the adjustment mechanism is positioned in the cavity and coupled to the mattress, and when the actuator is operated, the adjustment mechanism moves the adjustable bed system between a flat configuration in which the head portion is substantially coplanar with the foot portion and an inclined configuration in which the head portion is inclined relative to the foot portion.

2. The adjustable bed system of claim 1, wherein the head portion includes an upper subportion having a downward facing surface that defines the cavity, and the upper support of the adjustment mechanism is coupled to the downward facing surface.

3. The adjustable bed system of claim 2, wherein the upper support of the adjustment mechanism is coupled to the downward facing surface with a hook and loop fastener system.

4. The adjustable bed system of claim 3, wherein the upper support includes one or more support panels that form one side of the hook and loop fastener system, and the downward facing surface includes one or more mattress panels that form another side of the hook and loop fastener system and are coupled to the one or more support panels.

5. The adjustable bed system of claim 1, wherein the coupling portion does not move relative to a flat support surface on which the adjustable bed system is positioned when the adjustment mechanism moves the adjustable bed system between the flat configuration and the inclined configuration.

6. The adjustable bed system of claim 1, comprising one or more of the panels, each have a first end coupled to the lower base and a second end coupled to the coupling portion.

7. The adjustable bed system of claim 6, wherein the first end is coupled to the lower base with the zipper.

8. The adjustable bed system of claim 7, wherein the one or more panels cooperatively span less than half a width of the cavity.

9. The adjustable bed system of claim 7, wherein the one or more panels are releasably coupleable to the mattress at one or more of a head-end of the cavity or sides of the cavity.

10. The adjustable bed system of claim 9, wherein the one or more panels enclose the adjustment mechanism in the cavity.

11. The adjustable bed system of claim 6, wherein the second end is coupled to the coupling portion with the zipper.

12. An adjustable bed system comprising:

a mattress having a head portion and a foot portion; and an adjustment mechanism that lifts the head portion from a first configuration in which a first upper surface of the head portion and a second upper surface of the foot portion are substantially coplanar and a second configuration in which first upper surface is inclined relative to the second upper surface;

wherein in a third configuration, the mattress is folded such that the first upper surface faces the second upper surface and force is transferred from the first upper surface to the second upper surface.

13. The adjustable bed system of claim 12, wherein in the third configuration, the head portion of the mattress and the foot portion of the mattress are compressed by removable packaging.

14. The adjustable bed system of claim 13, wherein the removable packing is a vacuum bag in which the mattress and the adjustment mechanism are enclosed.

15. The adjustable bed system of claim 12, wherein the head portion of the mattress defines a cavity in which is positioned the adjustment mechanism.

16. The adjustable bed system of claim 12, wherein in the third configuration, the head portion of the mattress is compressed a lesser distance from a relaxed state thereof than is the foot portion of the mattress compressed from a relaxed state thereof.

17. The adjustable bed system of claim 12, wherein packaging retains the mattress in the third configuration.

18. An adjustable bed system comprising:

a mattress having a head portion and a foot portion; and an adjustment mechanism having a lower base, an upper support pivotably coupled to the lower base, and an actuator operable to move the upper support upward relative to the lower base;

wherein the adjustment mechanism is configured to raise the head portion of the mattress when the actuator is operated from a first configuration to a second configuration;

wherein the lower base of the adjustment mechanism is coupled to a coupling portion of the mattress to prevent movement of the lower base in a forward direction away from the foot portion of the mattress wherein a head end of the adjustment mechanism is releasably coupleable to a head end of the mattress;

wherein in the first configuration and a third configuration, the upper surfaces of the head portion and the foot portion are substantially coplanar, in the first configuration a head end of the adjustment mechanism is decoupled from the head end of the mattress, and in the third configuration, the head end of the adjustment mechanism is releasably coupled to the head end of the mattress.

19. The adjustable bed system of claim 18, wherein the lower base includes a frame having a head-end member and a foot-end member that are spaced apart longitudinally and a left side member and a right side member that are spaced apart laterally and extend between and are coupled to the head-end member and the foot-end member;

wherein the head-end member is coupled to the coupling portion of the mattress with a coupler extending therebetween.

20. The adjustable bed system of claim 19, wherein the coupler includes a flexible panel that is wrapped around the head-end member of the frame of the lower base.

21. The adjustable bed system of claim 20, wherein the frame of the lower base includes a stanchion that extends upward from the head-end member and engages the upper support when the adjustable bed system is in the first configuration, and wherein a forward end of the coupler is wrapped around the head-end member on different sides of the stanchion.

22. The adjustable bed system of claim 18, wherein in the first configuration, a head end of the base is not coupled to the head end of the mattress, and in the third configuration, the head end of the base is coupled to the head end of the mattress.

* * * * *